US009368318B2

(12) United States Patent
Eiter et al.

(10) Patent No.: US 9,368,318 B2
(45) Date of Patent: Jun. 14, 2016

(54) ROTARY X-RAY ANODE

(75) Inventors: Johann Eiter, Breitenwang (AT); Jürgen Schatte, Reutte (AT); Wolfgang Glatz, Reutte (AT); Wolfram Knabl, Reutte (AT); Gerhard Leichtfried, Reutte (AT); Stefan Schönauer, Pflach (AT)

(73) Assignee: Plansee SE, Reutte (AT)

( * ) Notice: Subject to any disclaimer, the term of this patent is extended or adjusted under 35 U.S.C. 154(b) by 341 days.

(21) Appl. No.: 13/980,585

(22) PCT Filed: Jan. 17, 2012

(86) PCT No.: PCT/AT2012/000009

§ 371 (c)(1),
(2), (4) Date: Aug. 7, 2013

(87) PCT Pub. No.: WO2012/097393

PCT Pub. Date: Jul. 26, 2012

(65) Prior Publication Data

US 2013/0308758 A1 Nov. 21, 2013

(30) Foreign Application Priority Data

Jan. 19, 2011 (AT) ..... GM34/2011

(51) Int. Cl.
*H01J 35/10* (2006.01)

(52) U.S. Cl.
CPC ..... *H01J 35/108* (2013.01); *H01J 2235/081* (2013.01)

(58) Field of Classification Search
CPC ..... H01J 35/08; H01J 2235/081
See application file for complete search history.

(56) References Cited

U.S. PATENT DOCUMENTS

| | | | | |
|---|---|---|---|---|
| 3,735,458 | A | 5/1973 | Magendans et al. | |
| 4,109,058 | A | 8/1978 | Love et al. | |
| 4,800,581 | A | 1/1989 | Kujirai et al. | |
| 6,487,275 | B1 | 11/2002 | Baba et al. | |
| 6,707,883 | B1 * | 3/2004 | Tiearney, Jr. ..... | H01J 35/108 378/143 |

(Continued)

FOREIGN PATENT DOCUMENTS

| | | | |
|---|---|---|---|
| EP | 0266157 | A1 | 5/1988 |
| JP | S52142492 | A | 11/1977 |
| JP | S5416196 | A | 6/1979 |
| JP | H02106862 | A | 4/1990 |
| JP | H11312484 | A | 11/1999 |
| RU | 2168235 | C1 | 5/2001 |

OTHER PUBLICATIONS

Alfonso A et al.: "Recrystallization kinetics of warm-rolled tungsten in the temperature range 1150-1350 C", Journal of Nuclear Materials Elsevier B.V. vol. 455, No. 1, Sep. 1, 2014, pp. 591-594 XP029100356.

(Continued)

*Primary Examiner* — Hoon Song
(74) *Attorney, Agent, or Firm* — Laurence A. Greenberg; Werner H. Stemer; Ralph E. Locher

(57) ABSTRACT

A rotary X-ray anode has a support body and a focal track formed on the support body. The support body and the focal track are produced as a composite by powder metallurgy. The support body is formed from molybdenum or a molybdenum-based alloy and the focal track is formed from tungsten or a tungsten-based alloy. Here, in the conclusively heat-treated rotary X-ray anode, at least one portion of the focal track is located in a non-recrystallized and/or in a partially recrystallized structure.

16 Claims, 3 Drawing Sheets

(56) References Cited

U.S. PATENT DOCUMENTS

| | | | | |
|---|---|---|---|---|
| 2001/0014568 | A1 | 8/2001 | Itoh et al. | |
| 2002/0168051 | A1 | 11/2002 | Lee et al. | |
| 2005/0135959 | A1 | 6/2005 | Subramanian et al. | |
| 2009/0290685 | A1 * | 11/2009 | Aoyama | C22C 1/045 378/144 |

OTHER PUBLICATIONS

Plansee-Tungsten—"Werkstoffeigenschaften and Anwendungen" [Material properties and applications], Internet Citation, Apr. 8, 2009, pp. 1-36, XP007908144, found on the Internet URL: http://www.plansee.com/lib/Tungsten_DE.pdf.

* cited by examiner

FIG. 3
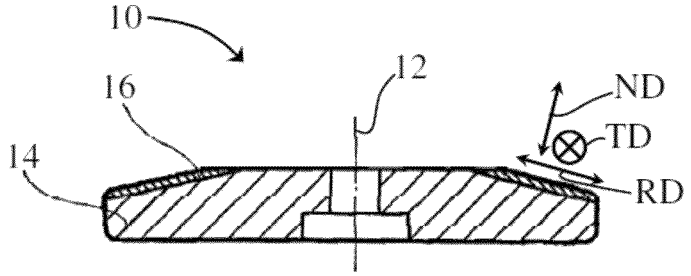
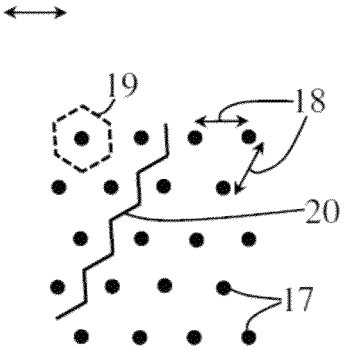
FIG. 4A
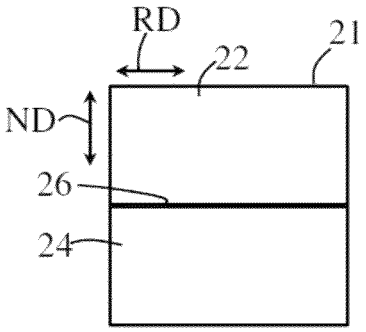
FIG. 4B
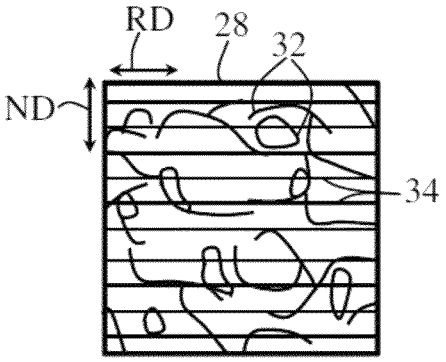
FIG. 4C
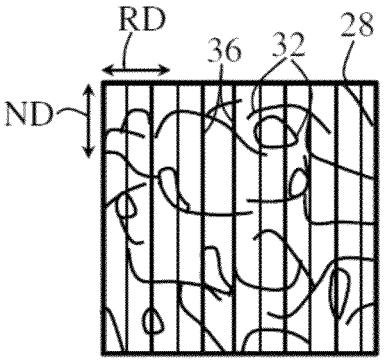
FIG. 4D

ROTARY X-RAY ANODE

BACKGROUND OF THE INVENTION

Field of the Invention

The present invention relates to a rotary X-ray anode, which has a support body and a focal track formed on the support body, wherein the support body and the focal track are produced as a composite by powder metallurgy, the support body is formed from molybdenum or a molybdenum-based alloy and the focal track is formed from tungsten or a tungsten-based alloy.

Rotary X-ray anodes are used in X-ray tubes for generating X-rays. During use, electrons are emitted from a cathode of the X-ray tube and accelerated in the form of a focused electron beam onto the rotary X-ray anode which is made to rotate. The majority of the energy of the electron beam is converted into heat in the rotary X-ray anode, while a small proportion is radiated as X-ray radiation. The locally released quantities of heat lead to severe heating of the rotary X-ray anode and to high temperature gradients. This leads to a high level of loading of the rotary X-ray anode. The rotation of the rotary X-ray anode counteracts overheating of the anode material.

Typically, rotary X-ray anodes have a support body and a coating which is formed on the support body, is designed specifically for generating X-rays and is referred to in the specialist field as a focal track. The support body and the focal track are formed from high-melting materials. In general, the focal track covers at least the region of the support body which is exposed to the electron beam during use. In particular, materials having a high atomic number, for example tungsten, tungsten-based alloys, in particular tungsten-rhenium alloys, etc., are used for the focal track. The support body, amongst other things, has to ensure effective dissipation of the heat which is released at the point of impact of the electron beam. Here, suitable materials (having a high thermal conductivity) have proved to be in particular molybdenum, molybdenum-based alloys, etc. A proven and comparatively inexpensive production process is production by powder metallurgy, in which the support body and the focal track are produced as a composite.

For a high radiation yield or dose yield (of X-ray radiation), it is essential that the surface of the focal track is as smooth as possible. With respect to the behavior over long-term use and the achievable service life, the focal track should be as stable as possible with respect to roughening of the focal track surface and also the formation of wide and/or deep cracks therein. Relatively high thermal and mechanical stresses arise on the support body on account of the high temperatures and temperature gradients and also on account of the high speeds of rotation. Despite these loads, the support body should be as stable as possible with respect to macroscopic deformations. To date, the prevailing opinion was that this stability can be obtained both in the focal track and in the support body by virtue of the fact that both the focal track and the support body are present in a completely recrystallized structure. In this respect, it was assumed that in this way the structure of the focal track and also the structure of the support body are largely stable with respect to subsequent changes in microstructure (e.g. with respect to recrystallization, etc.) even at the high operating temperatures which arise.

The recrystallization which takes place in the focal track during the existing production by powder metallurgy leads to relatively large grain sizes, however. Such structures entail the risk of the formation of relatively deep and wide cracks, which propagate preferably along the grain boundaries. Furthermore, in the case of large grain sizes, there is a greater tendency that a relatively coarse roughening of the focal track surface also arises over the period of use. A recrystallized structure in the support body has the effect that the strength and the hardness thereof are reduced. Particularly at high temperatures and in the case of high mechanical loads, plastic deformation of the support body may then occur (particularly if the yield stress is exceeded). Particularly in the high-power range, in which a high dose power (or radiation power) can be provided and the speed of rotation of the rotary X-ray anode is comparatively high, these critical values are to some extent exceeded. On account of the reduced high-temperature strength of the (completely recrystallized) support body material, accordingly the possibilities for using rotary X-ray anodes with a completely recrystallized structure of the support body are limited. To date, for applications in which a high strength and hardness of the support body is required even at high temperatures, use is made of special alloys and/or materials to which atomic impurities or impurities present as particles are added to increase the strength (cf. e.g. US 2005/0135959 A1).

U.S. Pat. No. 6,487,275 B1 describes a rotary X-ray anode having a focal track made of a tungsten-rhenium alloy, which has a grain size of 0.9 μm to 10 μm and which can be produced by a CVD coating process (CVD: chemical vapor deposition).

Accordingly, it is an object of the present invention to provide a rotary X-ray anode which can be produced as a composite by powder metallurgy, makes it possible to achieve a high dose yield over long periods of use and has a high service life.

BRIEF SUMMARY OF THE INVENTION

The object is achieved by a rotary X-ray anode as claimed in claim 1. Advantageous developments of the invention are indicated in the dependent claims.

According to the present invention, provision is made of a rotary X-ray anode, which has a support body and a focal track formed on the support body. Here, the support body and the focal track are produced as a composite by powder metallurgy, the support body is formed from molybdenum or a molybdenum-based alloy and the focal track is formed from tungsten or a tungsten-based alloy. In the conclusively heat-treated rotary X-ray anode, at least one portion of the focal track is present in a non-recrystallized and/or in a partially recrystallized structure.

Since at least one portion of the focal track is present in a non-recrystallized and/or in a partially recrystallized structure, this portion has no crystal grains formed by new grain formation (in the case of a non-recrystallized structure) or has crystal grains formed by new grain formation only to a proportion of considerably below 100% (partially recrystallized structure). The remaining proportion of this portion is present in a deformation structure, which, in production by powder metallurgy, is obtained by the deformation step, in particular by the forging operation. As a whole, what is obtained in the portion with the non-recrystallized and/or partially recrystallized structure is a very fine-grained structure (both in terms of the large-angle grain boundaries and large-angle grain boundary portions and also in terms of the small-angle grain boundaries), which has a high strength and hardness. This structure has a very smooth surface, which is advantageous in view of the dose yield. It has been found that, although this structure locally recrystallizes under the action of an electron beam (for example during "conditioning" or "entering" with the electron beam, and/or during use), the region in which recrystallization takes place is restricted to the immediate surroundings of the track of the electron beam on the focal track, and, depending on the thickness of the focal track, can extend down to the support body (and if appropriate into it). In the recrystallized region, the focal track then has an increased ductility, which is advantageous in view of avoiding cracking, and an increased thermal conductivity, which is advantageous in view of an effective heat dissipation on the support body. The surrounding regions of the focal track remain largely unchanged. In particular, they continue to be present in a non-recrystallized and/or a partially recrystallized structure and accordingly have a high strength and hardness. This is advantageous in view of stabilizing the recrystallized region of the focal track. Furthermore, it has surprisingly been found that the structure of the focal track which is locally recrystallized (during use) remains considerably more fine-grained than is the case in the recrystallization processes during the conventional production processes, in particular the conventional production processes by powder metallurgy. The focal track surface is smooth over long periods of use even in the regions with the recrystallized structure and has a uniform, finely distributed crack pattern. Accordingly, a high dose yield can be achieved over long periods of use with the rotary X-ray anode according to the invention. Furthermore, it has a high service life. One possible explanation for the fine-grained formation of the recrystallized structure of the focal track under the action of the electron beam is that abrupt transformation takes place by the action of the electron beam. In contrast, it has been found that recovery processes which influence the recrystallization behavior take place during the heat treatment carried out as part of the conventional production by powder metallurgy already upon heating in the furnace until the retaining temperature is reached.

Given a specific composition of the focal track, it is possible to obtain a higher start hardness (and a higher start strength) with an increasing degree of deformation (which is set during the deformation step, in particular the forging). Proceeding from this start hardness (and start strength), the hardness (and the strength) decreases with the degree of recrystallization of the structure. With an increasing degree of recrystallization, the ductility also increases. The preferential texturing in the <111> direction and the <001> direction perpendicular to the focal track plane as indicated hereinbelow in relation to one development is set in particular by the forging operation (under the action of a force substantially perpendicular to the focal track plane). It has been determined that this preferential texturing, too, decreases with the degree of recrystallization of the structure. Corresponding relationships also apply for the support body. From these dependencies, a person skilled in the art identifies how, for the respective composition of the focal track, he has to choose the parameters of the powder metallurgy production (in particular the temperature during forging, the degree of deformation in the forging operation, the temperature during the heat treatment, the duration of the heat treatment) in order to obtain the features indicated according to the invention in at least one portion of the focal track. In the present context, a partially recrystallized structure (with respect to the focal track and also with respect to the support body) is understood to mean a structure in which crystal grains formed by new grain formation are surrounded by a deformation structure, and in which, in terms of a cross-sectional area through the partially recrystallized structure, these crystal grains form an areal proportion in the range of 5-90%. If the areal proportion of the crystal grains formed by new grain formation lies in the region of less than 5%, or if no crystal grains formed by new grain formation are present in the structure at all, in the present context it is assumed that there is a non-recrystallized structure. If the areal proportion lies above 90%, in the present context it is assumed that there is a completely recrystallized structure. A possible measurement method suitable for determining the areal proportion is indicated below in connection with the description of FIGS. 4A-4D.

The rotary X-ray anode according to the invention is in particular a high-power rotary X-ray anode, which is designed for a high radiation power (or dose power) and a high speed of rotation. High-power rotary X-ray anodes of this type are used in particular in the medical sector, for example in computed tomography (CT) and for cardiovascular applications (CV). In general, further layers, add-on parts, etc., for example a graphite block, etc., can also be provided on the support body, in particular on the side which faces away from the focal track. In the case of high-power rotary X-ray anodes, additional dissipation of heat from the support body is generally required. In particular, the rotary X-ray anode according to the invention is designed for active cooling. In this case, a flowing fluid which serves for carrying heat away from the support body is routed immediately adjacent to or in the vicinity of the support body, in particular centrally through the rotary X-ray anode (e.g. through a channel running along the axis of rotational symmetry). Alternatively, a graphite body can be fitted on the rear side of the support body (e.g. by soldering, diffusion bonding, etc.) to increase the heat storage capacity of the rotary X-ray anode and to increase the heat radiation. Alternatively, the rotary X-ray anode can also be designed for lower radiation powers, however. In this case, active cooling and the fitting of a graphite block may be dispensed with, if appropriate.

A molybdenum-based alloy refers in particular to an alloy which comprises molybdenum as the main constituent, i.e. in a higher proportion (measured in percent by weight) than any of the respective other elements present. Special alloys having a high strength and hardness can also be used in particular as support body material and/or atomic impurities or particles can be added to the respective support body material to increase the strength. According to one development, the molybdenum-based alloy has a proportion of at least 80 (% by weight: percent by weight) molybdenum, in particular of at least 98% by weight molybdenum. A tungsten-based alloy refers in particular to an alloy which comprises tungsten as the main constituent. In particular, the focal track is formed from a tungsten-rhenium alloy having a rhenium proportion of up to 26% by weight. In particular, the rhenium proportion lies in a range of 5-10% by weight. Given these indicated compositions of the focal track and of the support body and particularly in the relatively narrow ranges indicated in each case, it is possible to achieve good properties with respect to hardness, temperature resistance and heat conduction.

A "conclusively heat-treated rotary X-ray anode" is understood to mean that the latter has undergone all heat treatment(s) carried out as part of the powder metallurgy production. The claimed features (and also the features explained below with respect to the dependent claims and variants) relate in particular to the end product (not yet in use) as is present after completion of the heat treatment(s) carried out as part of the powder metallurgy production. The production of the support body and of the focal track as a composite by powder metallurgy can be identified in the end product inter alia from the pronounced diffusion zone between the support body and the focal track. In alternative production processes, for example when the focal track is applied by means of CVD (CVD: chemical vapor deposition) or by means of vacuum plasma spraying, the diffusion zone typically has a smaller form or is virtually not present. The "portion" of the focal track refers in particular to a macroscopic, cohesive portion (i.e. comprising a multiplicity of grain boundaries and/or grain boundary portions) of the focal track. Here, a plurality of such portions having the claimed properties can also be present. In particular, the portion of the focal track over which (during use) the track of the electron beam runs has the claimed properties. In particular, the focal track has the claimed properties over its entire scope. A "non-recrystallized and/or partially recrystallized structure" refers to a structure which can be exclusively non-recrystallized, which can be exclusively partially recrystallized or which in certain portions can be non-recrystallized and in certain portions can be partially recrystallized.

According to one development, the portion of the focal track has a preferential texturing in the <111> direction with a texture coefficient $TC_{(222)}$ determinable by way of X-ray diffraction (XRD) of ≥4 and a preferential texturing in the <001> direction with a texture coefficient $TC_{(200)}$ determinable by way of X-ray diffraction of ≥5 perpendicular to a focal track plane (with $$TC_{(hkl)} = \frac{\dfrac{I_{(hkl)}}{\sum_{j=1}^{n} I_{j(hkl)}}}{\dfrac{I^{0}_{(hkl)}}{\sum_{j=1}^{n} I^{0}_{j(hkl)}}}$$

where $I_{(hkl)}$ is the measured intensity of the peak (hkl), $I^{0}_{(hkl)}$ is the texture-free intensity of the peak (hkl) in accordance with the JCPDS database, and n is the number of evaluated peaks, the following peaks having been evaluated: (110), (200), (211), (220), (310), (222) and (321)). Accordingly, in the focal track, the <111> direction and the <001> direction are oriented along the normal of the focal track plane to a greater extent than along the directions parallel to the focal track plane. Here, the "focal track plane" is determined by the main area of extent of the focal track. If the focal track plane is curved (which is the case for example if the focal track has a frustoconical course), reference is made to the main area of extent thereof which is present in the respective measurement or reference point of the focal track.

As is mentioned above, the preferential texturing in the <111> direction and the <001> direction is set perpendicular to the focal track plane by the forging operation and decreases with an increasing degree of recrystallization of the focal track. The degree of recrystallization in turn increases with an increasing temperature and with an increasing duration of the heat treatment (during and/or after the forging). Accordingly, the texture coefficients indicated are also a measure of the degree of recrystallization of the focal track. In particular, the degree of recrystallization of the focal track is all the lower the higher the texture coefficients in these directions. Within the ranges of the texture coefficients which are indicated according to this development, the portion of the focal track is present in a non-recrystallized structure or in a partially recrystallized structure with a relatively low degree of recrystallization. In this respect, it has been determined that, within these ranges, the advantageous properties explained above (high hardness, fine-grained nature) of the focal track can be achieved, these advantageous properties arising to an even greater extent in the case of even higher texture coefficients. According to one development, the portion of the focal track has a texture coefficient $TC_{(222)}$ of ≥5 and/or a texture coefficient $TC_{(200)}$ of ≥6 perpendicular to the focal track plane. If the degree of deformation is lower (for example only in the range of a (total) degree of deformation of the rotary X-ray anode of 20%-30%), the preferential texturings indicated above are also less pronounced. According to one development, the portion of the focal track has a texture coefficient $TC_{(222)}$ of ≥3.3 and/or a texture coefficient $TC_{(200)}$ of ≥4 perpendicular to the focal track plane, the range of these low limit values being approached in particular in the case of relatively low degrees of deformation.

Tungsten and tungsten-based alloys have a body centered cubic crystal structure. With the indications of direction in the angular brackets < . . . >, reference is also made in each case to the equivalent directions. By way of example, the <001> direction comprises, in addition to the [001] direction, also the directions [001], [010], [002], [200] and [100] (in each case based on a body centered cubic elementary cell). The round brackets ( . . . ) denote in each case lattice planes. The peaks evaluated during the XRD measurement are each denoted with the associated lattice planes (for example (222)). Here, it is in turn to be taken into consideration that, as is known in the specialist field, the peak which can be evaluated during the XRD measurement in relation to the lattice plane (222) is also weighted by the lattice planes equivalent thereto (e.g. (111), etc.). Accordingly, the intensity of the peak (222) determined by means of XRD measurement and in particular the texture coefficient $TC_{(222)}$ ascertained therefrom is a measure of the preferential texturing in the <111> direction (perpendicular to the focal track plane). Correspondingly, the intensity of the peak (200) determined by means of XRD measurement and in particular the texture coefficient $TC_{(200)}$ ascertained therefrom is a measure of the preferential texturing in the <001> direction.

The texture coefficient was calculated in each case in accordance with the following formula:

$$TC_{(hkl)} = \frac{\dfrac{I_{(hkl)}}{\sum_{j=1}^{n} I_{j(hkl)}}}{\dfrac{I^{0}_{(hkl)}}{\sum_{j=1}^{n} I^{0}_{j(hkl)}}} \quad \text{e.g. for } TC_{(222)}: \quad TC_{(222)} = \frac{\dfrac{I_{(222)}}{\sum_{j=1}^{n} I_{j(hkl)}}}{\dfrac{I^{0}_{(222)}}{\sum_{j=1}^{n} I^{0}_{j(hkl)}}}$$

Here, $I_{(hkl)}$ denotes the intensity of the relevant peak (hkl), determined by way of XRD measurement, in respect of which the texture coefficient $TC_{(hkl)}$ is to be determined. The maximum of the relevant peak (hkl) as was detected during the XRD measurement is to be used in each case as the "specific intensity" of a peak (hkl). For determining the respective texture coefficient $TC_{(hkl)}$, the following intensities of the peaks (110), (200), (211), (220), (310), (222) and (321) determined by way of XRD measurement are added up in total over $I_{j(hkl)}$ of j=1 to n (i.e. in the present case: n=7). $I^{0}_{(hkl)}$ denotes the (generally standardized) texture-free intensity of the relevant peak (hkl) in respect of which the texture coefficient $TC_{(hkl)}$ is to be determined. This texture-free intensity would be present when the relevant material has no texturing. Correspondingly, the texture-free intensities of these seven peaks are added up in total over $I^{0}_{j(hkl)}$ of j=1 to n. The texture-free intensities in relation to the respective peaks can be taken from databases, with in each case the data relating to the main constituent of the relevant material being consulted. Accordingly, in the present case, the Powder Diffraction File for tungsten (JCPDS No. 00-004-0806) was used for the focal track. In particular, the texture-free intensity 100 was used for the peak (110), the texture-free intensity 15 was used for the peak (200), the texture-free intensity 23 was used for the peak (211), the texture-free intensity 8 was used for the peak (220), the texture-free intensity 11 was used for the peak (310), the texture-free intensity 4 was used for the peak (222) and the texture-free intensity 18 was used for the peak (321).

Hereinbelow, a sample preparation and a measurement process which were employed in the present case for determining the intensities of the various peaks by way of X-ray diffraction are described. Firstly, the focal track is abraded in such a manner that the region of the forging zone (upper region of the focal track, which, during the forging operation, was in direct contact with the forging tool or in the immediate vicinity of the forging tool) is removed, if this has not already been removed completely in the finished rotary X-ray anode. In particular, the focal track is abraded to a residual thickness of 0.1-0.5 mm with an abrasion plane parallel to the focal track plane (depending on the starting thickness of the focal track). Then, the abraded surface obtained is electropolished repeatedly, at least twice (to remove the deformation structure brought about by the abrasion operation). As the XRD measurement was being carried out, the sample was rotated and diffraction was excited over an area having a diameter of approximately 10 mm. To carry out the XRD measurement, use is made of a theta/2 theta diffraction geometry. In the present case, the diffracted intensities were measured in a topogram with a step size of 0.020° and with in each case a measuring time of 2 seconds per measured angle. The X-ray radiation used was Cu—Kα1 radiation having a wavelength of 1.5406 Å. The additional effects which arise owing to the additionally present Cu—Kα2 radiation in the radiograph obtained were subtracted out by appropriate software. Then, the maxima of the peaks for the seven peaks indicated above are determined. In the present case, the XRD measurements were carried out with a Bragg-Brentano diffractometer "D4 Endeavor" from Bruker axs with a theta/2 theta diffraction geometry, a Göbel mirror and a Sol-X detector. As is known in the specialist field, however, it is also possible to use a different appliance with corresponding settings such that comparable results are achieved.

Molybdenum and molybdenum-based alloys likewise have a body centered cubic crystal structure. Accordingly, the notations explained above in relation to the focal track, the formula for determining the texture coefficient, the sample preparation and also the measurement process are correspondingly applicable. In the course of the sample preparation, the rotary X-ray anode, unlike in the process explained above, is abraded down to the support body material, the abraded surface running parallel to the focal track plane. For the texture-free intensities of the support body, use was made of the Powder Diffraction File for molybdenum (JCPDS No. 00-042-1120). In particular, the texture-free intensity 100 was used for the peak (110), the texture-free intensity 16 was used for the peak (200), the texture-free intensity 31 was used for the peak (211), the texture-free intensity 9 was used for the peak (220), the texture-free intensity 14 was used for the peak (310), the texture-free intensity 3 was used for the peak (222) and the texture-free intensity 24 was used for the peak (321).

According to one development, the following relationship for the texture coefficients $TC_{(222)}$ and $TC_{(310)}$ determinable by way of X-ray diffraction is satisfied for the portion of the focal track perpendicular to the focal track plane:

$$\frac{TC_{(222)}}{TC_{(310)}} \geq 5.$$

This ratio describes the extent to which the peak (222) has widened or smeared out. If the peak (222) has smeared out to a great extent, the intensity of the (adjacent) peak (310) is also increased thereby and therefore the value of the ratio is reduced. It is accordingly applicable that the greater the ratio the lesser the extent to which the peak (222) has smeared out. In this respect, it has been determined that, in the case of rotary X-ray anodes according to the invention, in which the portion of the focal track is present in a non-recrystallized and/or in a partially recrystallized structure, this ratio is considerably higher than in the case of rotary X-ray anodes produced conventionally as a composite by powder metallurgy. In particular, this ratio decreases with an increasing degree of recrystallization. Accordingly, this ratio is a variable which characterizes the focal track, where given relatively high values of this ratio the preferred properties described above (fine-grained nature, low roughening) for the focal track are present to a particular extent. In particular, this ratio is ≥7. With a low degree of deformation, this ratio can also have a value of lower than 5, however. In particular, this ratio is ≥4 or ≥3.5, the range of these relatively low limit values being achieved in particular in the case of rotary X-ray anodes having a low degree of deformation (for example having a (total) degree of deformation in the range of 20%-30%). Nevertheless, these relatively low limit values are also higher than in the case of rotary X-ray anodes produced conventionally as a composite by powder metallurgy.

According to one development, the portion of the focal track has a hardness of ≥350 HV 30. As explained above, such a high hardness is advantageous particularly in respect of avoiding roughening and/or deformation of the focal track over its period of use. For the indications of hardness made in the course of this description, reference is made in each case to a hardness determination in accordance with DIN EN ISO 6507-1, where use is to be made in particular of a load application time of 2 seconds (pursuant to DIN EN ISO 6507-1: 2 to 8 seconds) and an effective duration or load retention time of 10 seconds (pursuant to DIN EN ISO 6507-1: 10 to 15 seconds). Particularly in the case of molybdenum and molybdenum-based alloys, a deviation from this load application time and effective duration can have an effect on the measured value obtained. The hardness measurement (both for the focal track and for the support body) is carried out in particular on a radial cross-sectional area of the rotary X-ray anode running perpendicular to the focal track plane.

According to one development, the portion of the focal track is present entirely in a partially recrystallized structure. In particular, the entire focal track is present entirely in a partially recrystallized structure. According to one development, crystal grains formed in the partially recrystallized structure by new grain formation are surrounded by a deformation structure, and, in terms of a cross-sectional area through the partially recrystallized structure, these crystal grains have an areal proportion in the range of 10% to 80%, in particular in a range of 20% to 60%. Within these ranges, and in particular within the narrower range, good properties of the focal track in terms of its surface quality and dose yield could be achieved, even over long periods of use. The method for determining the areal proportion which can be employed for the indicated value range will be explained with reference to the figures (cf. in particular the description relating to FIGS. 4A-4D). As an alternative to the developments explained above, it can also be provided that the portion or if appropriate also the entire focal track is present in a non-recrystallized structure. According to a further development, it is generally provided (irrespective of whether the portion is present in a partially recrystallized and/or in a non-recrystallized structure) that the areal proportion (of the crystal grains formed by new grain formation) is ≤80%, in particular ≤60%.

According to one development, the portion of the focal track has a mean small-angle grain boundary spacing of ≤10 μm. Here, the mean small-angle grain boundary spacing can be determined by a measurement process in which grain boundaries, grain boundary portions and small-angle grain boundaries with a grain boundary angle of ≥5° are determined on a radial cross-sectional area running perpendicular to the focal track plane in a region of the portion of the focal track, to determine the mean small-angle grain boundary spacing parallel to the focal track plane, a group of lines which runs parallel to the cross-sectional area and is made up of lines which each run parallel to the focal track plane and are at a spacing of in each case 17.2 μm in relation to one another is placed into the grain boundary pattern thereby obtained, respectively the spacings between in each case two mutually adjacent intersections between the respective line and lines of the grain boundary pattern are determined on the individual lines, and the mean value of these spacings is determined as the mean small-angle grain boundary spacing parallel to the focal track plane, to determine the mean small-angle grain boundary spacing perpendicular to the focal track plane, a group of lines which runs parallel to the cross-sectional area and is made up of lines which each run perpendicular to the focal track plane and are at a spacing of in each case 17.2 μm in relation to one another is placed into the grain boundary pattern obtained, respectively the spacings between in each case two mutually adjacent intersections between the respective line and lines of the grain boundary pattern are determined on the individual lines, and the mean value of these spacings is determined as the mean small-angle grain boundary spacing perpendicular to the focal track plane, and the mean small-angle grain boundary spacing is determined as the geometric mean value of the mean small-angle grain boundary spacing parallel to the focal track plane and of the mean small-angle grain boundary spacing perpendicular to the focal track plane. Further details relating to how the measurement process is carried out are given in the description of FIGS. 4A-4D. A fine-grained structure of this type having a mean small-angle grain boundary spacing of ≤10 μm is advantageous in particular with a view to avoiding roughening of the focal track surface. This fine-grained nature of the structure also depends in turn on the degree of deformation. Accordingly, a small mean small-angle grain boundary spacing can be achieved particularly in the case of a high degree of deformation of the rotary X-ray anode. In particular, according to one development, the mean small-angle grain boundary spacing is ≤5 μm. In the case of a low degree of deformation of the rotary X-ray anode, the small-angle grain boundary spacing is somewhat higher. In particular, according to one development, it is ≤15 μm, where even this relatively high limit value is still lower than the corresponding value for rotary X-ray anodes produced conventionally as a composite by powder metallurgy.

One characteristic variable as to whether and to what extent a substructure is present is the ratio between the mean (large-angle) grain boundary spacing (i.e. grain boundary angle of ≥15°) and the mean (small-angle) grain boundary spacing (i.e. grain boundary angle of ≥5°). The higher this ratio is, the lower the degree of recrystallization. According to one development, this ratio is ≥1.2. In particular, the ratio is ≥1.5, more preferably ≥2.

According to one development, the portion of the focal track has a preferential texturing in the <101> direction in directions parallel to the focal track plane. Here, the degree of recrystallization of the focal track is all the lower, the higher the preferential texturing in the <101> direction in these directions parallel to the focal track plane. The ratio of the preferential texturing in the <101> direction in the directions parallel to the focal track plane in relation to the preferential texturings in the <111> direction and the <001> direction can be estimated by means of an EBSD analysis (EBSD: Electron Backscatter Diffraction). The EBSD analysis can be used to determine preferential texturings and corresponding EBSD texture coefficients both in directions parallel to the focal track plane and perpendicular to the focal track plane, where for this purpose only one sample area (e.g. a cross-sectional area as shown in FIG. 3) has to be examined. The sample preparation and the measurement process are explained in general with reference to FIGS. 4A-4D, where details relating to the determination of the EBSD texture coefficient (in particular the precise processing of the measured values) are not provided. Even without specifying the exact determination process for the EBSD texture coefficients, it is possible to obtain information relating to the form of the preferential texturings in the various directions (perpendicular and also parallel to the focal track plane) from the comparison of the various EBSD texture coefficients. Here, an EBSD texture coefficient of 5.5 was determined for the <111> direction and an EBSD texture coefficient of 5.5 was determined for the <001> direction in the case of a sample according to the invention perpendicular to the focal track plane. Parallel to the focal track plane, in the case of this sample according to the invention, an EBSD texture coefficient of 2.5 was determined in the radial direction (RD) for the <110> direction and an EBSD texture coefficient of 2.2 was determined in the tangential direction (TD) for the <110> direction. Accordingly, it can be determined that the preferential texturing in the <110> direction (or <101> direction) in directions parallel to the focal track plane is less pronounced, in particular is pronounced to an extent of less than half, than the preferential texturings in the <111> direction and the <001> direction perpendicular to the focal track plane (this was confirmed on the basis of further samples).

According to one development, the focal track has a thickness (measured perpendicular to the focal track plane) in the range of 0.5 mm to 1.5 mm. In use, a thickness in the region of approximately 1 mm has proved suitable in particular. According to one development, the focal track and/or the support body has a relative density of ≥96%, in particular of ≥98% (relative to the theoretical density), which is particularly advantageous in terms of the material properties and the heat conduction. The density is measured in particular in accordance with DIN ISO 3369.

According to one development, (in the conclusively heat-treated rotary X-ray anode) at least one portion of the support body is present in a non-recrystallized and/or in a partially recrystallized structure. It has been found that, compared to support bodies having a recrystallized structure, a support body having these features has a high stability with respect to macroscopic deformations particularly under high, mechanical loads. Support bodies of this type are particularly well-suited for actively cooled rotary X-ray anodes, in which, on account of the active cooling, the temperature of the support body (or at least large portions thereof) can be held in a range below the recrystallization threshold. Furthermore, support bodies of this type are also very well-suited for lower ranges of radiation power (so-called mid- and low-end range). If a graphite body is to be fitted on the rear side of the support body, it is preferably fitted in such a way (for example by means of diffusion bonding) that heating of the support body (or parts thereof) above the recrystallization threshold thereof is avoided. Since, according to the present invention, the focal track is present at least in certain portions in a non-recrystallized and/or partially recrystallized structure, the support body can also be produced in a non-recrystallized and/or in a partially recrystallized structure in a cost-effective and simple manner as a composite by powder metallurgy. According to one development, the portion of the support body has a hardness of ≥230 HV 10, in particular of ≥260 HV 10. These ranges are advantageous in terms of a high stability of the support body with respect to macroscopic deformations, with a particularly high stability being provided in the range of a relatively high hardness.

In a manner corresponding to that described above in relation to the focal track, there are mutual dependencies of the hardness, the degree of deformation, the degree of recrystallization and the ductility in the case of the support body too (given a specific composition thereof). From these dependencies, a person skilled in the art identifies how, for the respective composition of the support body, he has to choose the parameters of the powder metallurgy production (in particular the temperature during forging, the degree of deformation in the forging operation, the temperature during the heat treatment, the duration of the heat treatment) in order to obtain the features indicated in relation to the support body in at least one portion thereof. "Portion" of the support body refers in particular to a macroscopic, cohesive portion (i.e. comprising a multiplicity of grain boundaries and/or grain boundary portions) of the support body. Here, a plurality of such portions having the claimed properties can also be present. In particular, the support body has the respectively claimed properties over its entire scope.

A further advantage of this development is that conventional materials and material combinations can be used for the support body, which is advantageous in particular in terms of the production outlay and the costs. The use of special alloys and/or the addition of atomic impurities or particles to the support body material in order to increase its hardness and strength is/are not required. According to one development, the support body is formed from a molybdenum-based alloy, the further alloying constituents of which (apart from impurities caused by for example oxygen) are formed by at least one element from the group consisting of Ti (Ti: titanium), Zr (Zr: zirconium), Hf (Hf: hafnium) and by at least one element from the group consisting of C (C: carbon), N (N: nitrogen). The proportion of oxygen here in principle should be as small as possible. According to one development, the support body material is formed by a molybdenum alloy (referred to as TZM), which is specified in the standard ASTM B387-90 for powder metallurgy production. The TZM alloy has in particular a Ti proportion (Ti: titanium) of 0.40-0.55% by weight, a Zr proportion of 0.06-0.12% by weight (Zr: zirconium), a C proportion of 0.010-0.040% by weight (C: carbon), an 0 proportion of less than 0.03% by weight (O: oxygen), and the remaining proportion (apart from impurities) Mo (Mo: molybdenum). According to one development, the support body material is formed by a molybdenum alloy having an Hf proportion of 1.0 to 1.3% by weight (Hf: hafnium), a C proportion of 0.05-0.12% by weight, an 0 proportion of less than 0.06% by weight, and the remaining proportion (apart from impurities) molybdenum (this alloy is sometimes also referred to as MHC). In both compositions, oxygen forms an impurity, the proportion of which is to be kept as small as possible. Said compositions have proved to be very suitable in terms of good heat conduction and in handling during production.

According to one development, the portion of the support body has a preferential texturing in the <111> direction and in the <001> direction perpendicular to the focal track plane. According to one development, the portion of the support body has a preferential texturing in the <101> direction in directions parallel to the focal track plane. The preferential texturings indicated are set during the forging operation in a manner corresponding to that explained above in relation to the focal track. They are reduced again with an increasing degree of recrystallization. From these dependencies, a person skilled in the art identifies in turn (in a manner corresponding to that explained above in terms of the focal track) how, for the respective composition of the support body, he has to choose the parameters of the powder metallurgy production in order to obtain the preferential texturing indicated in at least one portion of the support body. According to one development, the portion of the support body has a preferential texturing in the <111> direction with a texture coefficient $TC_{(222)}$ determinable by way of X-ray diffraction of ≥5 and in the <001> direction with a texture coefficient $TC_{(200)}$ determinable by way of X-ray diffraction of ≥5 perpendicular to the focal track plane. According to one development, these texture coefficients $TC_{(222)}$ and $TC_{(200)}$ are each at least ≥4 (where the range directly above this low limit value can be reached in particular in the case of a low degree of deformation). A low degree of recrystallization and accordingly a high distinctness of the preferential texturings are advantageous in terms of a high hardness and stability of the support body. Accordingly, according to one development, the texture coefficients $TC_{(222)}$ and $TC_{(200)}$ are each at least 5.5.

In the forging operation, the force acts substantially perpendicular to the focal track plane. During the production process, this direction in which the force acts is generally substantially parallel to the (future) axis of rotational symmetry of the rotary X-ray anode. If the focal track plane has a substantially planar form, this symmetry is retained. If the focal track plane, by contrast, is not planar but rather, for example, has a frustoconical form (cf. e.g. FIG. 3), the outer circumferential portion is generally deviated through a desired angle (e.g. in the range of 8°-12°) after or during the forging operation. The texture of the focal track and of the support body which is established during the forging is retained in the process. Accordingly, in relation to the texture of the support body, reference is furthermore made to the focal track plane (or to the interface between the focal track and the support body). On account of the change in shape which is described in the case of a deviated focal track, the texture of the support body may differ slightly in a central region (in a central region, a plane running perpendicular to the axis of rotational symmetry is then decisive strictly speaking instead of the focal track plane).

According to one development, the portion of the support body has an elongation at break of ≥2.5% at room temperature. In particular, the portion of the support body has an elongation at break of ≥5% at room temperature. For the elongation at break, it must in turn be taken into consideration that, with an increasing degree of recrystallization of the support body, its ductility and therefore its elongation at break at room temperature increases. On account of this dependency, a person skilled in the art can appropriately choose the parameters of the powder metallurgy production (in particular the duration and temperature of the heat treatment(s)) so that the respective value ranges for the elongation at break are achieved. The measurement process which corresponds to the details relating to the elongation at break is to be performed in accordance with DIN EN ISO 6892-1, where in each case a sample running radially in the support body is used as the measurement sample. Here, method B described in DIN EN ISO 6892-1 and based on the stress rate is to be employed in particular.

The present invention furthermore relates to the use of a rotary X-ray anode according to the invention, which can if appropriate be formed according to one or more of the developments and/or variants mentioned above, in an X-ray tube for generating X-ray radiation.

The present invention furthermore relates to a process for producing a rotary X-ray anode according to the invention, which is if appropriate formed according to one or more of the developments and/or variants described above, the process comprising the following steps:

A) providing a starting body produced as a composite by pressing and sintering corresponding starting powders with a support body portion made of molybdenum or a molybdenum-based mixture and a focal track portion, formed on the support body portion, made of tungsten or a tungsten-based mixture;

B) forging the body; and

C) subjecting the body to a heat treatment during and/or after the forging step;

wherein the heat treatment is carried out at such low temperatures and for such a period of time that, in the conclusively heat-treated rotary X-ray anode, at least one portion of the focal track obtained from the focal track portion is present in a non-recrystallized and/or in a partially recrystallized structure. The pressing and sintering are effected here in such a manner that a dense and homogeneous sintered body (hereinbelow: body) is obtained (as is known in the specialist field). The sintered body has in particular a relative density of ≥94% (based on the theoretical density). The rotary X-ray anode according to the invention as explained above can be obtained in particular by the production process indicated. The process can here also comprise even further steps. In particular, it can be provided that the steps of forging and heat treatment are performed repeatedly in sequence. The last heat treatment can be carried out in particular in vacuo. According to one development, it is provided that the forging is carried out at elevated temperatures in order to sufficiently lower the deformation resistance of the material, and that a heat treatment (stress relief annealing) is additionally carried out following the forging operation.

According to one development, the heat treatment is effected (during the forging and/or during a heat treatment following the forging operation) at temperatures below the recrystallization temperature of the focal track, in particular at temperatures in the region of the recrystallization threshold of the focal track. According to one development, the heat treatment is effected (during the forging and/or during a heat treatment following the forging operation) at temperatures below the recrystallization temperature of the support body, in particular at temperatures in the region of the recrystallization threshold of the support body. The recrystallization temperature depends inter alia on the respective (material) composition and also on the degree of deformation of the respective material. The higher the degree of deformation, the lower the recrystallization temperature. Depending on the form of the rotary X-ray anode, regions with differing degrees of deformation can also exist. According to one development, the heat treatment is carried out at temperatures ≤1500° C., in particular at temperatures in a range of 1300-1500° C. Particularly in the case of a support body made of TZM or having the specific composition indicated above of Mo, Hf, C and O, these temperatures are suitable for achieving the desired properties both for the focal track and for the support body. The duration of a heat treatment carried out after the forging operation is in particular a few hours, e.g. in the range of 1-5 hours.

According to one development, the forged body has a degree of deformation of at least 20%, in particular in the range of 20% to 60%, after completion of the forging. Degrees of deformation of up to 80% are also possible, however. During the forging, the force acts in particular parallel to the axis of rotational symmetry of the rotary X-ray anode, which is oriented precisely or substantially perpendicular to the focal track plane(s). The degree of deformation here refers to the ratio of the change in height of the respective body achieved parallel to the direction in which force acts in relation to the initial height thereof (along the direction in which force acts).

BRIEF DESCRIPTION OF THE SEVERAL VIEWS OF THE DRAWING

Further advantages and functionalities of the invention become apparent on the basis of the following description of exemplary embodiments with reference to the accompanying figures, in which:

FIG. 3: shows a schematic cross-sectional view of a rotary X-ray anode;

FIG. 4A-4D: show a schematic illustration for visualizing an EBSD analysis;

DESCRIPTION OF THE INVENTION

Figure 1A:
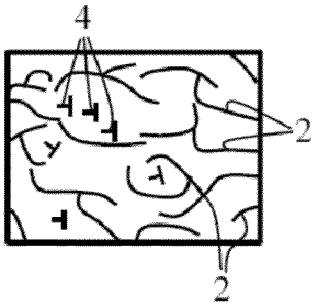
FIG. 1A-1C: show schematic illustrations for visualizing different degrees of recrystallization.
Figure 1C:
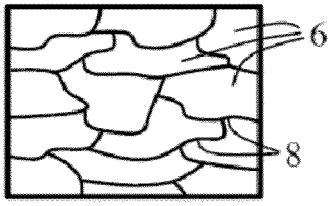
Figure 1B:
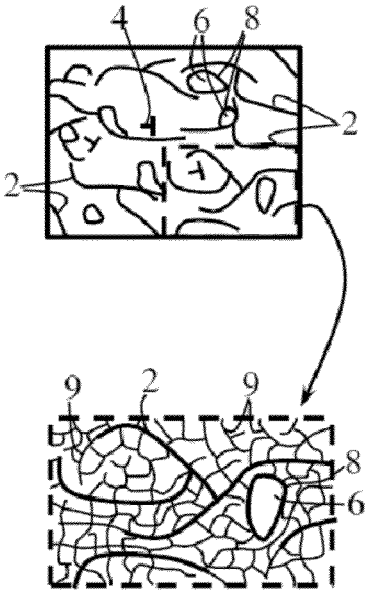
Figure 2:
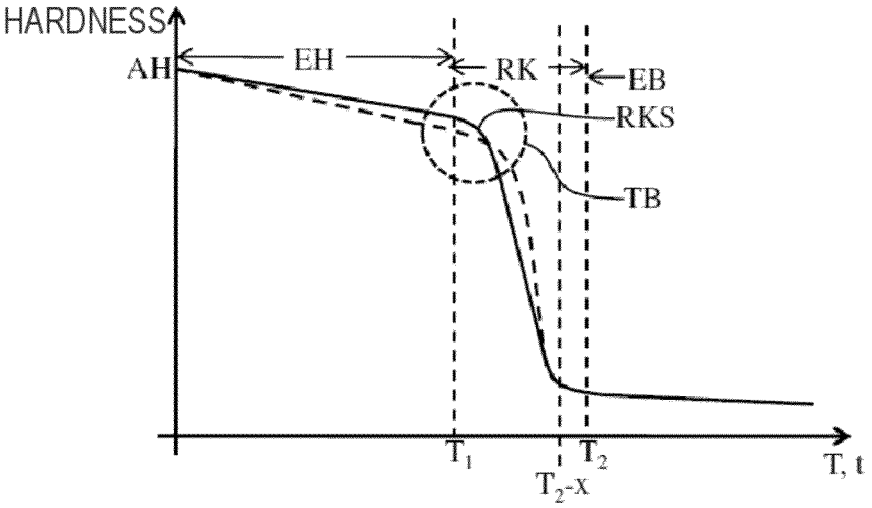
FIG. 2: shows a schematic graph for visualizing the hardness profile depending on the temperature of a heat treatment.

The following explanation of FIGS. 1A-1C and 2 reveals criteria which can be used to distinguish a non-recrystallized structure, a partially recrystallized structure and a (completely) recrystallized structure from one another. Furthermore, parameters which can be used to state the degree of recrystallization are explained on the basis of these figures. These explanations apply both with respect to the focal track and with respect to the support body. FIGS. 1A-1C schematically show (greatly enlarged) structures as can be represented, for example, in an electron micrograph of a correspondingly prepared abraded surface, in particular in the course of an EBSD analysis (EBSD: Electron Backscatter Diffraction). A suitable process for sample preparation, a suitable measurement arrangement and a suitable measurement process will be explained with reference to FIGS. 4A to 4D. As is known in the specialist field, the grain boundaries or grain boundary portions (and also if appropriate the small-angle grain boundaries) and the dislocations can be made visible in such an electron micrograph. To this end, it is necessary to specify a minimum angle of rotation beyond which a grain boundary is indicated. In FIGS. 1A to 1C, it is assumed (apart from the section shown separately in FIG. 1B) that a minimum angle of rotation of 15° has been specified, so that the profile of the large-angle grain boundaries (or grain boundary portions) is visible. FIG. 2 schematically shows, proceeding from a starting hardness -AH- obtained in the course of the powder metallurgy production after the forging process (starting hardness -AH- of the deformation structure), the dependency of the hardness on the temperature -T- of a subsequent heat treatment (stress relief annealing), which is carried out for a predetermined period of time -t-, for example for a period of time of one hour. If the heat treatment is carried out for a longer predetermined period of time, the step shown in FIG. 2 shifts more to the left (i.e. toward lower temperatures), whereas it shifts more to the right (i.e. toward higher temperatures) in the case of a shorter period of time.

FIG. 1A shows a pure deformation structure as is obtained, for example, after a forging operation (which is carried out in the course of the powder metallurgy production). As is known in the specialist field, such a deformation structure has no clear grain boundaries circulating corresponding crystal grains. Instead, what can merely be identified are grain boundary portions -2- which each have an open beginning and/or an open end. To some extent, here (depending on the degree of deformation during the forging operation) portions of the grain boundaries of the original grains of the sintered body can also be identified. Furthermore, the deformation (forging operation) forms dislocations -4-, which are represented by the symbol "⊥" in FIGS. 1A and 1B, and new grain boundary portions -2-. The original grains of the sintered body are, if they can still be identified, greatly squashed and distorted on account of the deformation. Furthermore, the deformation structure has a substructure, which can be made visible using an EBSD analysis of the respective abraded surface with a relatively small minimum angle of rotation being set. This substructure of the deformation structure will be explained below with reference to FIG. 1B. With an increasing degree of deformation, the original grain boundaries (of the grains of the sintered body) disappear in certain portions or even entirely. The intensity and frequency of these typical features of the deformation structure depend inter alia on the (material) composition and the degree of deformation. In particular, it is to be taken into account that, with an increasing degree of deformation, small-angle grain boundary portions arise increasingly and also the frequency of large-angle grain boundary portions increases. A determination of the mean grain size, which is regularly effected in the case of uniform microstructures in accordance with the standard ASTM E 112-96, is not possible since (at least in the case of a minimum angle of rotation of 15°) only grain boundary portions can be identified.

Recovery processes which increase with an increasing temperature generally proceed in the deformation structure. For such recovery processes, which can be identified for example from disappearance and/or ordering of dislocations, no activation energy is required. These recovery processes lead to a decrease in hardness. In this range -EH- of the recovery processes (range up to $T_1$ in FIG. 2), the hardness decreases continuously with an increasing temperature, the slope in this range -EH- being relatively flat (cf. FIG. 2). Above a specific temperature -$T_1$-, the activation energy required for new grain formation in the course of the recrystallization can be applied. This temperature -$T_1$- is dependent inter alia on the composition and the degree of deformation of the deformation structure and also on the duration of the heat treatment carried out in each case. If recrystallization occurs, there is (firstly) a partially recrystallized structure. FIG. 1B shows a partially recrystallized structure having a number of crystal grains -6- formed by new grain formation. The crystal grains (or crystallites) -6- each have circumferential grain boundaries -8-, which can be represented for example in an electron micrograph of a correspondingly prepared abraded surface, in particular using an EBSD analysis (EBSD: Electron Backscatter Diffraction). The remaining proportion (or the proportion surrounding the crystal grains -6-) of the partially recrystallized structure is still present in the deformation structure. On account of the new grain formation and in some cases on account of recovery processes, the dislocations -4- which arise in the deformation structure disappear increasingly.

As has already been mentioned, a further feature of the deformation structure is that it has a substructure. Such a substructure can be made visible using an EBSD analysis by specifying a relatively small minimum angle of rotation, for example by a minimum angle of rotation of 5° (or possibly also an even smaller angle). In this way, the small-angle grain boundaries -9- which form the substructure can also be identified in addition to the large-angle grain boundaries (grain boundary portions -2- and circumferential grain boundaries -8-). This is shown in FIG. 1B in the bottom box, in which a section of the structure shown in the box above is illustrated on an enlarged scale. The small-angle grain boundaries -9- of the substructure are shown in this illustration as relatively thin lines. As can be seen on the basis of this illustration, the large-angle grain boundaries of the grain boundary portions -2- are to some extent also continued by small-angle grain boundaries -9-. The crystal grains -6- formed by new grain formation are in this case free from the substructure. In the case of the rotary X-ray anode according to the invention, the substructure -9- of the deformation structure has in particular a fine-grained form.

With an increasing recrystallization, which increases with the temperature (and also the time) of the heat treatment, the hardness decreases greatly (cf. FIG. 2). In FIG. 2, above the temperature -$T_1$- the previously flatly falling graph passes over into a region with a steeply falling slope. The transition region between the flatly falling portion and the steeply falling portion of the graph, in particular the point with the greatest curvature, is referred to as the recrystallization threshold -RKS- (cf. FIG. 2). With an increasing degree of recrystallization, the crystal grains which have already been formed by new grain formation are enlarged, further crystal grains are formed by new grain formation and the deformation structure disappears increasingly. In particular, the deformation structure is increasingly "consumed" by the crystal grains formed by new grain formation. With a further increasing degree of recrystallization, the grain boundaries of the crystal grains formed by new grain formation collide, and finally also fill (at least largely) the remaining interstices. In this stage, the crystal growth slows down again, and in FIG. 2 the slope of the graph flattens out. What is reached is a state in which the recrystallization is completed to an extent of 99%, in particular in which the crystal grains formed by new grain formation have an areal proportion of 99% with respect to a cross-sectional area through the structure. The recrystallization temperature, which in FIG. 2 corresponds to -$T_2$- (in FIG. 2, the duration of the heat treatment is one hour), is defined in this case in such a way that, after a heat treatment of one hour at this recrystallization temperature, the recrystallization is completed to an extent of 99%. The region -RK-, which extends beginning from the temperature -$T_1$- up to the recrystallization temperature -$T_2$-, is referred to as the recrystallization region, since recrystallization processes proceed therewithin to a considerable extent. Finally, the graph passes over into a region -EB-, in which it no longer falls or falls only in a very flat manner. In this region, although grain growth still occurs, no recrystallization takes place or recrystallization takes place only to a very small extent (in particular of the remaining one percent of the structure).

FIG. 1C shows an idealized, completely recrystallized structure. The grain boundaries of the crystal grains formed by new grain formation directly adjoin one another. The original deformation structure has completely disappeared. Here, FIG. 1C shows the "ideal case" of a completely recrystallized structure, since the grain boundaries adjoin one another in each case along their entire direction of extent.

FIG. 3 schematically shows the structure of a rotary X-ray anode -10-, which is formed with rotational symmetry in relation to an axis of rotational symmetry -12-. The rotary X-ray anode -10- has a plate-shaped support body -14-, which can be mounted on a corresponding shaft. An annular focal track -16- is applied on the top side of the support body -14- and, in the embodiment illustrated, has a frustoconical form (a flat cone). The focal track -16- covers at least a region of the support body -14- which, during use, is traversed by an electron beam. In general, the focal track -16- covers a region of the support body which is larger than that of the track of the electron beam. The outer form and the structure of the rotary X-ray anode -10- can differ from the rotary X-ray anode shown, as is known in the specialist field. As is apparent with reference to FIG. 3, the (macroscopic) proportion of the non-recrystallized and/or partially recrystallized structure (both for the focal track and for the support body) can generally be established by virtue of the fact that a radial (i.e. running through the axis of rotational symmetry -12-) cross-sectional area running perpendicular to the focal track plane is examined as to which regions are present in a non-recrystallized and/or in a partially recrystallized structure.

Hereinbelow, an EBSD analysis (EBSD: Electron Backscatter Diffraction) which can be carried out with a scanning electron microscope is explained with reference to FIGS. 4A to 4D. In the course of such an EBSD analysis, a characterization of the respective structure can be carried out on a microscopic level. In particular, in the course of such an EBSD analysis, the fine-grained nature of the respective structure can be determined, the occurrence and the extent of substructures can be ascertained, the proportion of the crystal grains formed by new grain formation in a partially recrystallized structure can be determined and also preferential texturings which arise in the structure can be determined. To this end, in the course of the sample preparation, a cross-sectional area running radially and perpendicular to the focal track plane (corresponds to the cross-sectional area shown in FIG. 3) through the rotary X-ray anode is produced. A corresponding abraded surface is prepared in particular by embedding, abrading, polishing and etching at least one portion of the obtained cross-sectional area of the rotary X-ray anode, with the surface then also being subjected to ion polishing (to remove the deformation structure formed by the abrasion process on the surface). Here, the abraded surface to be examined can be chosen in particular in such a way that it comprises a portion of the focal track and a portion of the support body of the rotary X-ray anode, so that both portions can be examined. The measurement arrangement is such that the electron beam impinges on the prepared abraded surface at an angle of 20°. In the case of the scanning electron microscope (in the present case: Carl Zeiss "Ultra 55 plus"), the spacing between the electron source (in the present case: field emission cathode) and the sample is 16.2 mm and the spacing between the sample and the EBSD camera (in the present case: "DigiView IV") is 16 mm. The information provided between parentheses relates in each case to the types of appliance used by the applicant, where in principle other types of appliance which make the described functions possible can also be used in a corresponding manner. The acceleration voltage is 20 kV, a 50-fold magnification is set and the spacing between the individual pixels on the sample which are scanned in succession is 4 μm.

The individual pixels -17- are in this case arranged in equilateral triangles in relation to one another, the length of a side of a triangle corresponding in each case to the grid spacing -18- of 4 μm (cf. FIG. 4A). The information for an individual pixel -17- originates here from a volume from the respective sample which has a surface with a diameter of 50 nm (nanometers) and a depth of 50 nm. The information for a pixel is then represented in the form of a hexagon -19- (shown with a dashed line in FIG. 4A), the sides of which in each case form the perpendicular bisectors between the relevant pixel -17- and the (six) pixels -17- located closest in each case. The examined sample area -21- measures in particular 1700 μm by 1700 μm. As shown in FIG. 4B, it comprises in the present case, in a top half, a focal track portion -22- (in cross section) measuring approximately 850 by 1700 $\mu m^2$ and, in the bottom half, a support body portion -24- (in cross section) measuring approximately 850 by 1700 $\mu m^2$. The interface -26- (between the focal track and the support body) here runs parallel to the focal track plane and centrally through the examined sample area -21- (in each case parallel to the sides thereof). Furthermore, it runs parallel to the radial direction -RD- (cf. e.g. direction -RD- in FIGS. 3, 4B). As is explained above with reference to FIG. 4A, the examined sample area -21- is scanned with a grid of 4 μm.

To determine the mean grain boundary spacing (or small-angle grain boundary spacing), grain boundaries and grain boundary portions having a grain boundary angle of greater than or equal to a minimum angle of rotation within the examined sample area -21- are made visible using the EBSD analysis. In the present case, a minimum angle of rotation of 15° is set in the scanning electron microscope to determine the mean grain boundary spacing. The examined portion of the rotary X-ray anode in this case has an (overall) degree of deformation of 60%. Here, it is to be taken into consideration that, on account of the high hardness of the focal track, the (local) degree of deformation of the focal track per se is lower, whereas the (local) degree of deformation of the support body is higher at least in certain portions. In particular, the degree of deformation of the support body increases away from the focal track in a direction perpendicular to the focal track plane toward the bottom. Accordingly, the result of the examination is dependent respectively on the (overall) degree of deformation of the examined portion and also on the position of the examined sample area -21-. On account of the explained position of the examined sample area -21- in the region of the interface -26-, both the examined focal track portion -22- and the examined support body portion -24- are spaced apart from the interface -26- by less than 1 mm (this is relevant in particular in terms of the support body, in which different degrees of deformation arise depending on the height, i.e. in a direction parallel to the axis of rotational symmetry). The scanning electron microscope determines and represents, within the examined sample area -21-, grain boundaries or grain boundary portions between two grid points -17- whenever a difference in orientation of the respective lattice of ≥15° is determined between the two grid points -17- (if a different minimum angle of rotation is set, the latter is significant). The difference in orientation used in each case is the smallest angle which is required to transfer the respective crystal lattices present at the respective grid points -17- to be compared into one another. This process is carried out for each grid point -17- in respect of all grid points surrounding it (i.e. in each case in respect of six surrounding grid points). FIG. 4A shows, by way of example, a grain boundary portion -20-. A grain boundary pattern -32- which is formed in the case of a partially recrystallized structure (given a minimum angle of rotation of 15°) by grain boundary portions and circumferential grain boundaries is thereby obtained within the examined sample area -21-. This is represented schematically in FIGS. 4C and 4D for a section -28- of the focal track. If a minimum angle of rotation of 5° is set, the small-angle grain boundaries of the substructure can also be made visible in addition (these are not shown in FIGS. 4C and 4D).

Hereinbelow, the determination of the mean grain boundary spacing of the focal track material parallel to the focal track plane will be explained. To determine the grain boundary spacing of the focal track material, in each case only the focal track portion -22- measuring approximately 850 by 1700 $\mu m^2$ of the examined sample area -21- is evaluated. Here, in the process explained in the present case, the mean grain boundary spacing is determined along the direction -RD-, i.e. along a direction running parallel to the focal track plane (or to the interface -26- in FIG. 4B) and substantially radially. To this end, a group -34- of 98 lines each having a length of 1700 μm and a relative spacing of 17.2 μm (1700 μm/99) is placed into the grain boundary pattern -32- within the examined sample area -21- (which has an area of 1700×1700 $\mu m^2$). In FIG. 4C, this is shown schematically for a section -28- of the focal track placed within the examined focal track portion -22-. The group of lines -34- here runs parallel to the examined surface (or cross-sectional area) and the individual lines each run parallel to the direction -RD-. Respectively the spacings between in each case two mutually adjacent intersections between the respective line and lines of the grain boundary pattern -32- are determined on the individual lines. In the regions in which the end of a line does not form an intersection with a line of the grain boundary pattern -32- (i.e. forms an open end because it reaches the boundary of the examined focal track portion -22-), the length of the portion from the line end up to the first intersection with a line of the grain boundary pattern -32- is evaluated as half a crystal grain. The frequency of the various spacings which were determined within the focal track portion -22- (approximately 850×1700 $\mu m^2$) is evaluated, and then a mean value of the spacings is formed (corresponds to the sum total of the detected spacings divided by the number of measured spacings). The process described for determining the mean grain boundary spacing is also referred to as "Intercept Length". The determination of the mean grain boundary spacing perpendicular to the focal track plane, i.e. along the direction -ND-, is effected correspondingly within the focal track portion -22-. In turn, a group -36- of (again 98) lines is placed into the grain boundary pattern -32-. The group of lines -36- here runs parallel to the examined surface (or cross-sectional area) and the individual lines each run parallel to the direction -ND-. This is shown schematically for the section -28- in turn in FIG. 4D. The spacings are evaluated in a manner corresponding to that explained above. In this way, it is possible to indicate a measure of the fine-grained nature of the structure which is formed from (large-angle) grain boundaries and (large-angle) grain boundary portions. The mean grain boundary spacing parallel to the focal track plane is in this case generally greater than the mean grain boundary spacing perpendicular to the focal track plane. This effect is brought about by the action of force perpendicular to the focal track plane during the forging operation. The mean grain boundary spacing d can then be determined from the mean grain boundary spacing parallel to the focal track plane $d_p$ and the mean grain boundary spacing perpendicular to the focal track plane $d_s$, as is apparent on the basis of the following equation:

$$d=\sqrt{d_p \times d_s}$$

In a corresponding manner, the determination of the mean (small-angle) grain boundary spacing of the portion of the focal track parallel and also perpendicular to the focal track plane can be carried out stating a minimum angle of rotation of 5°. The mean small-angle grain boundary spacing can then be determined therefrom in turn in accordance with the formula indicated above. By stating a minimum angle of rotation of 5°, the small-angle grain boundaries of the substructure (which is present in the deformation structure) are additionally taken into consideration. In this way, it is possible to indicate a measure of the fine-grained nature of the structure which is formed from (large-angle) grain boundaries, (large-angle) grain boundary portions and small-angle grain boundaries.

The degree of recrystallization can be determined on a microscopic level by virtue of the fact that the areal proportion of the crystal grains formed by new grain formation (relative to the total area of the examined portion) is determined in a microsection, as shown schematically for example in FIGS. 1A-1C. This determination can be effected in turn with a scanning electron microscope during an EBSD analysis. In this respect, reference is made to the measurement arrangement and sample preparation explained above with reference to FIGS. 4A to 4D and the measurement process explained. The minimum angle of rotation stated here is in particular an angle of ≥15°, so that the profile of the large-angle grain boundaries can be seen. In this way, it is possible to determine in particular the circumferential grain boundaries of the crystal grains formed by new grain formation and also the (large-angle) grain boundary portions. Furthermore, in addition the same region can also be examined stating a minimum angle of rotation of ≥5° (or another small value for the minimum angle of rotation) in order to check whether the individual crystal grains are crystal grains formed by new grain formation (these do not have a substructure). Then, the ratio of the area of the crystal grains formed by new grain formation relative to the total area examined is determined.

Furthermore, the degree of recrystallization can also be estimated on the basis of the hardness. This can be effected, for example, by virtue of the fact that, after the forging operation, a plurality of samples produced in the same way are each subjected to heat treatments for a predetermined duration at a respectively different temperature (if appropriate, in addition or as an alternative the duration of the heat treatment can also be varied). A hardness measurement is then carried out on the samples at an identical position in each case (within the sample). Thus, substantially the course of the curve shown in FIG. 2 can be traced, and it is possible to establish the region of the curve in which the respective sample lies. As explained above, work is preferably performed within the region -TB- around the recrystallization threshold -RKS- (the region -TB- in FIG. 2 being shown schematically by the circle with dashed lines around the recrystallization threshold -RKS-).

Within the context of determining the degree of recrystallization, it is generally to be taken into consideration that extended recovery processes take place in the case of certain materials (e.g. in the case of molybdenum and molybdenum alloys). According to a notion which is sometimes represented, these recovery processes can also lead to nuclei for new grain formation. Where new grain formation takes place from these nuclei, within the context of this description this type of new grain formation is also encompassed by the term recrystallization. If extended recovery processes occur, the graph in FIG. 2 already falls to a greater extent in the region of the recovery processes -EH-, and the recrystallization threshold can shift toward higher temperatures. At least in the region -EB-, in which the structure is recrystallized, the graph then again runs in a manner corresponding to that in the case of a material without extended recovery processes. In particular, in terms of quality there is a deviation, as shown schematically in FIG. 2 by the dashed line. In the case of molybdenum-based alloys, this effect is additionally superposed by the formation of particles, which can likewise have an effect on the specific curve profile. In terms of quality, however, the curve profile is always substantially as shown in FIG. 2.

The text which follows explains the production of a rotary X-ray anode according to the invention according to one embodiment of the present invention. Firstly, the starting powders for the support body are mixed and also the starting powders for the focal track are mixed. The starting powders for the support body are chosen in such a manner that what is obtained for the support body (apart from impurities) is a composition of 0.5% by weight Ti, 0.08% by weight zirconium, 0.01-0.04% by weight carbon, less than 0.03% by weight oxygen and the remaining proportion molybdenum (after the conclusion of all heat treatments carried out as part of the powder metallurgy production) (i.e. TZM). Furthermore, the starting powders are chosen in such a manner that what is obtained for the focal track (apart from impurities) is a composition of 10% by weight rhenium and 90% by weight tungsten. The starting powders are pressed as a composite with 400 tons (corresponds to $4*10^5$ kg) per rotary X-ray anode. Then, the body obtained is sintered at temperatures in the range of 2000° C.-2300° C. for 2 to 24 hours. The starting body (sintered body) obtained after the sintering has in particular a relative density of 94%. The starting body obtained after the sintering is forged at temperatures in the range of 1300° C. to 1500° C. (preferably at 1300° C.), with the body having a degree of deformation in the range of 20-60% (preferably of 60%) after the forging step. After the forging step, the body is subjected to a heat treatment at temperatures in the range of 1300° C. to 1500° C. (preferably at 1400° C.) for 2 to 10 hours. Where ranges are indicated within the context of this exemplary embodiment, good results can be achieved respectively for various combinations within the respective region. Whereas the parameters indicated for the pressing step and for the sintering step are less critical for the properties according to the invention of the focal track (and substantially also for the described advantageous properties of the support body), the temperatures during the forging step and during the subsequent heat treatment in particular have an effect on the properties of the focal track (in particular on the degree of recrystallization thereof). In particular, particularly good results are achieved given the temperature values indicated with preference for the forging step and for the step of the subsequent heat treatment (given the degree of deformation indicated with preference of 60%).

In the case of rotary X-ray anodes which were produced according to the exemplary embodiment explained above, it was possible to achieve a hardness of 450 HV 30 for the focal track and a hardness of 315 HV 10 for the support body. The hardness measurements here are to be carried out on a cross-sectional area running through the axis of rotational symmetry. In the case of the support body, it was further possible to achieve a 0.2% elongation limit $R_{p\,0.2}$ of 650 MPa (megapascals) and an elongation at break A of 5% at room temperature. In this respect, a sample running radially in the support body is to be used as the measurement sample. Method B described in DIN EN ISO 6892-1 and based on the stress rate is to be employed as the measurement process. In comparison to this, hardnesses of at most 220 HV 10 and also lower elongation limits are typically achieved in the case of conventional support bodies produced by powder metallurgy (except for special alloys and materials reinforced with additional particles).

Accordingly, these results show that considerably higher hardnesses (of the focal track and also of the support body) and higher elongation limits (at least in the case of the support body) are achieved in the case of the rotary X-ray anodes according to the invention than in the case of rotary X-ray anodes produced conventionally by powder metallurgy. Furthermore, these investigations show that sufficient ductilization of the support body material can be achieved by a heat treatment, following the forging operation, at temperatures in the region of the recrystallization threshold (of the support body material). In the case of such a "gentle" ductilization (i.e. heat treatment at relatively low temperatures), there is the simultaneous effect that the structure of the focal track continues to remain very fine-grained. The ductilization achieved can be identified in particular on the basis of the values obtained for the elongation at break A at room temperature. In the case of a sample which has not been heat-treated, the elongation at break of the (pressed, sintered and forged) support body material is typically ≤1%. The ductilization can avoid a situation where the rotary X-ray anodes are brittle and fragile.

On rotary X-ray anodes formed according to the invention, the focal track was examined at the end of its service life. In this case, it was possible to determine that cracks are diverted in each case along the grain boundaries of the fine-grain structure and therefore repeatedly change the direction of propagation. On account of this crack diversion along the fine-grained structure, the propagation of cracks deep into the focal track is avoided. It was also possible to observe a uniformly distributed crack pattern with uniformly formed cracks on the surface of the focal track at the end of its service life. By contrast, on comparative rotary X-ray anodes in which the focal track was produced by vacuum plasma spraying, the crystals of the focal track have a columnar form and are oriented perpendicular to the focal track plane. A crack consequently propagates along the grain boundaries deep into the focal track (and if appropriate down to the support body).

Figure 5A:
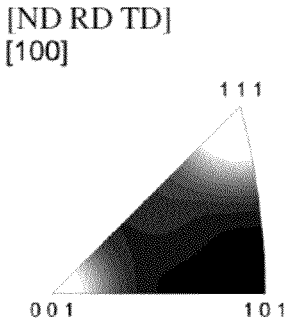
FIG. 5A-5C: show inverse pole figures of the focal track of a rotary X-ray anode according to the invention along different directions.
Figure 5B:
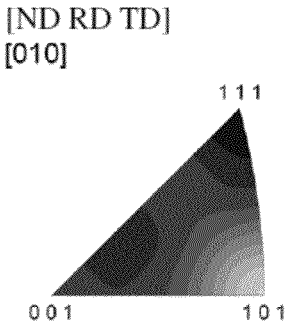
Figure 5C:
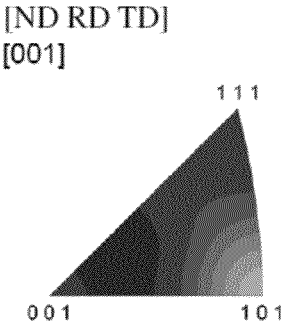

To investigate the texture of the focal track and of the support body, a rotary X-ray anode as explained above with reference to FIGS. 4A to 4D was prepared as the sample to be examined. The rotary X-ray anode here was formed according to the invention. The focal track had (apart from impurities) a composition of 90% by weight tungsten and 10% by weight rhenium, whereas the support body (apart from impurities) had a composition of 0.5% by weight Ti, 0.08% by weight zirconium, 0.01-0.04% by weight carbon, less than 0.03% by weight oxygen and the remaining proportion molybdenum. The measurement arrangement too corresponds to the arrangement explained above. In the measurement process, the settings explained above with reference to FIGS. 4A to 4D were used, insofar as these are applicable or are to be performed for determining the texture. The inverse pole figures obtained in the course of the EBSD analysis of the focal track are shown in FIGS. 5A-5C. In this respect, the macroscopic directions perpendicular to one another, -ND-, which runs perpendicular to the focal track plane in the respectively examined region, -RD-, which runs substantially radially and parallel to the focal track plane, and also -TD-, which runs tangentially and parallel to the focal track plane, were defined in relation to the focal track (these directions are drawn in for visualization in FIG. 3). In the forging operation during the process for producing the associated rotary X-ray anode, the force acted perpendicular to the focal track plane (i.e. along the direction -ND-). FIG. 5A shows the inverse pole figure of the focal track in the direction -ND-, FIG. 5B shows the inverse pole figure in the direction -RD- and FIG. 5C shows the inverse pole figure in the direction -TD-. The pronounced preferential texturing in the <111> direction and the <001> direction along the direction -ND- can be identified with reference to FIG. 5A. Furthermore, the (less) pronounced preferential texturing in the <101> direction along the directions -RD- and -TD- can be identified with reference to FIGS. 5B and 5C. Corresponding results were achieved for the texture of the support body which was determined in the outer region of the rotary X-ray anode. In particular, a pronounced preferential texturing in the <111> direction and the <001> direction along the direction -ND- and also a (somewhat less) pronounced preferential texturing in the <101> direction along the directions -RD- and -TD- were measured.

Figure 6:
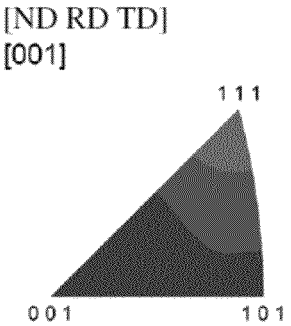
FIG. 6: shows an inverse pole figure of a focal track which was applied by means of CVD.
Figure 7:
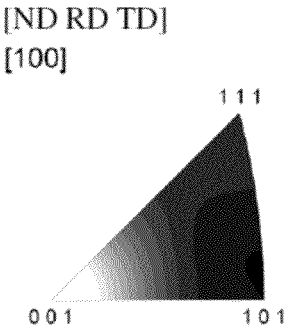
FIG. 7: shows an inverse pole figure of a focal track applied by vacuum plasma spraying.

For comparison, correspondingly prepared samples of a focal track made of pure tungsten and applied by a CVD process (cf. FIG. 6) and of a focal track produced by vacuum plasma spraying (cf. FIG. 7) and made of a tungsten-rhenium alloy (tungsten proportion: 90% by weight, rhenium proportion: 10% by weight) were investigated in respect of their texture. FIG. 6 in this respect shows the inverse pole figure in the direction -TD-. As is apparent with reference to FIG. 6, the focal track applied by CVD coating has a preferential texturing in the <111> direction along the direction -TD-. FIG. 7 shows the inverse pole figure in the direction -ND-. As is apparent with reference to FIG. 7, the focal track produced by vacuum plasma spraying has a pronounced preferential texturing in the <001> direction along the direction -ND-.

The invention claimed is:

1. A rotary X-ray anode, comprising:

a powder-metallurgically produced composite formed of a support body and a focal track on said support body;

said support body being formed of molybdenum or a molybdenum-based alloy;

said focal track being formed of tungsten or a tungsten-based alloy; and wherein, in a conclusively heat-treated rotary X-ray anode, at least one portion of said focal track is present in a non-recrystallized or a partially recrystallized structure;

wherein the at least one portion of said focal track has a mean small-angle grain boundary spacing of ≤10 μm;

wherein the mean small-angle grain boundary spacing can be determined by a measurement process in which grain boundaries, grain boundary portions and small-angle grain boundaries with a grain boundary angle of ≥5° are determined on a radial cross-sectional area running perpendicular to said focal track plane in a region of the at least one portion of the focal track;

to determine the mean small-angle grain boundary spacing parallel to the focal track plane, a group of lines which runs parallel to the cross-sectional area and is made up of lines each running parallel to the focal track plane and at a spacing of in each case 17.2 μm in relation to one another is placed into the grain boundary pattern thereby obtained, respectively the spacings between in each case two mutually adjacent intersections between the respective line and lines of the grain boundary pattern are determined on the individual lines, and the mean value of these spacings is determined as the mean small-angle grain boundary spacing parallel to the focal track plane;

to determine the mean small-angle grain boundary spacing perpendicular to the focal track plane, a group of lines which runs parallel to the cross-sectional area and is made up of lines each running perpendicular to the focal track plane and at a spacing of in each case 17.2 μm in relation to one another is placed into the grain boundary pattern obtained, respectively the spacings between in each case two mutually adjacent intersections between the respective line and lines of the grain boundary pattern are determined on the individual lines, and the mean value of these spacings is determined as the mean small-angle grain boundary spacing perpendicular to the focal track plane; and the mean small-angle grain boundary spacing is determined as a geometric mean value of the mean small-angle grain boundary spacing parallel to the focal track plane and of the mean small-angle grain boundary spacing perpendicular to the focal track plane.

2. The rotary X-ray anode according to claim 1, wherein said at least one portion of said focal track has, in a direction perpendicular to a focal track plane, a preferential texturing in a <111> direction with a texture coefficient $TC_{(222)}$ of ≥4 determinable by way of X-ray diffraction and a preferential texturing in a <001> direction with a texture coefficient $TC_{(200)}$ of ≥5 determinable by way of X-ray diffraction.

3. The rotary X-ray anode according to claim 1, wherein the following relationship for the texture coefficients $TC_{(222)}$ and $TC_{(310)}$ determinable by way of X-ray diffraction is satisfied for the portion of the focal track perpendicular to the focal track plane:

$$TC_{(222)}/TC_{(310)} \geq 5.$$

4. The rotary X-ray anode according to claim 1, wherein the at least one portion of said focal track has a hardness of ≥350 HV 30.

5. The rotary X-ray anode according to claim 1, wherein the at least one portion of said focal track is present in a partially recrystallized structure.

6. The rotary X-ray anode according to claim 5, wherein:

crystal grains formed in the partially recrystallized structure by new grain formation are surrounded by a deformation structure; and in terms of a cross-sectional area through the partially recrystallized structure, the crystal grains have an areal proportion in a range of 10% to 80%.

7. The rotary X-ray anode according to claim 1, wherein said at least one portion of said focal track has a preferential texturing in a <101> direction in directions parallel to a plane of said focal track plane.

8. The rotary X-ray anode according to claim 1, wherein at least one portion of said support body is present in a non-recrystallized or partially recrystallized structure.

9. The rotary X-ray anode according to claim 8, wherein the at least one portion of said support body has a hardness of ≥230 HV 10.

10. The rotary X-ray anode according to claim 8, wherein:

said at least one portion of said support body has a preferential texturing in a <111> direction and in a <001> direction perpendicular to the focal track plane; and/or said at least one portion of said support body has a preferential texturing in the <101> direction in directions parallel to said focal track plane.

11. The rotary X-ray anode according to claim 8, wherein said at least one portion of said support body has an elongation at break of ≥2.5% at room temperature.

12. The rotary X-ray anode according to claim 1, wherein said support body is formed of a molybdenum-based alloy, having further alloying constituents including at least one alloying constituent selected from the group consisting of Ti, Zr and Hf, and at least one alloying constituent selected from the group consisting of C and N.

13. A method of generating X-ray radiation which comprises providing a rotary X-ray anode according to claim 1 in an X-ray tube and generating the X-ray radiation therewith.

14. A method of producing a rotary X-ray anode, the method which comprises:

providing a starting body produced as a composite by pressing and sintering corresponding starting powders, the starting body having a support body portion made of molybdenum or a molybdenum-based mixture and a focal track portion, formed on the support body portion, made of tungsten or a tungsten-based mixture;

forging the starting body; and subjecting the body to a heat treatment during the forging step, after the forging step, or during and after the forging step, to form a rotary X-ray anode according to claim 1;

adjusting a temperature of the heat treatment and a processing time of the heat treatment such that, in the finally and conclusively heat-treated rotary X-ray anode, at least one portion of the focal track obtained from the focal track portion is present in a non-recrystallized and/or in a partially recrystallized structure.

15. The method according to claim 14, which comprises carrying out the heat treatment at temperatures in a range of 1300° C.-1500° C.

16. The method according to claim 14, wherein the forged body has a degree of deformation in a range of 20% to 60% after completion of the forging step.

* * * * *